US011896113B2

(12) United States Patent
Tarajano Noya et al.

(10) Patent No.: US 11,896,113 B2
(45) Date of Patent: Feb. 13, 2024

(54) COSMETIC PRODUCT SAMPLING SYSTEM

(71) Applicant: ELC MANAGEMENT LLC, Melville, NY (US)

(72) Inventors: Lemis Tarajano Noya, Miami, FL (US); Robyn Lynne Adams, Long Island City, NY (US); Marc Emile Lechanoine, New York, NY (US); Gianluca Mattaroccia, Sunnyside, NY (US); Timothy Hugh Calvert, Brentwood, TN (US); Douglas John Melenkevitz, Boonton, NJ (US)

(73) Assignee: ELC MANAGEMENT LLC, Melville, NY (US)

( * ) Notice: Subject to any disclaimer, the term of this patent is extended or adjusted under 35 U.S.C. 154(b) by 278 days.

(21) Appl. No.: 17/345,321

(22) Filed: Jun. 11, 2021

(65) Prior Publication Data

US 2022/0395079 A1 Dec. 15, 2022

(51) Int. Cl.

| | |
|---|---|
| ***A45D 40/24*** | (2006.01) |
| ***A45D 33/26*** | (2006.01) |
| ***A45D 40/22*** | (2006.01) |

(52) U.S. Cl.

CPC ..... *A45D 40/24* (2013.01); *A45D 33/26* (2013.01); *A45D 40/22* (2013.01);

(Continued)

(58) Field of Classification Search

CPC .. A45D 33/26; A45D 34/04; A45D 2034/005; A45D 2040/0018;

(Continued)

(56) References Cited

U.S. PATENT DOCUMENTS 2,497,950 A * 2/1950 Lohr ..... A45D 40/16 206/229

2,588,611 A 3/1952 Breen (Continued)

FOREIGN PATENT DOCUMENTS

CN 110891454 A 3/2020
KR 20200030928 A 3/2020

(Continued)

OTHER PUBLICATIONS

Winky Lux, "Mini Lipstick Kit," (2021). Retrieved from Internet on Jun. 11, 2021: URL: https://www.winkylux.com/products/mini-lip-pill-kit.

(Continued)

*Primary Examiner* — Rachel R Steitz

(74) *Attorney, Agent, or Firm* — MARSHALL, GERSTEIN & BORUN LLP

(57) ABSTRACT

A system for sample, trial, and/or full-sized products includes a container defining at least one cavity, a product disk, a cosmetic product, and an applicator. The product disk includes a first side, a second side, a body extending therebetween, and a disk release mechanism. At least a portion of the first side of the product disk is selectively positionable adjacent to the at least one cavity of the container. The cosmetic product is at least partially disposed on the first side of the product disk. The applicator has first end that includes an applicator retention region and an applicator release region. The product disk is insertably coupled with the applicator retention region.

17 Claims, 8 Drawing Sheets

(52) U.S. Cl.
CPC ..... *A45D 2200/052* (2013.01); *A45D 2200/1036* (2013.01); *A45D 2200/25* (2013.01)

(58) Field of Classification Search
CPC ..... A45D 2040/0043; A45D 2040/204; A45D 40/14; A45D 40/16; A45D 40/18; A45D 40/24; A45D 40/26; A45D 2200/052; A45D 2200/10; A45D 2200/1036; A45D 2200/25
USPC ..... 206/581, 564
See application file for complete search history.

(56) References Cited

U.S. PATENT DOCUMENTS

| | | | |
|---|---|---|---|
| 6,094,771 | A | 8/2000 | Egolf et al. |
| 6,611,986 | B1 | 9/2003 | Seals |
| 6,997,321 | B2 | 2/2006 | Young |
| 8,226,311 | B2 | 7/2012 | Cronin |
| 9,220,332 | B1 | 12/2015 | DeVito |
| 9,277,798 | B2 | 3/2016 | Moreau |
| 9,974,377 | B2 | 5/2018 | Keller et al. |
| 2003/0105425 | A1 | 6/2003 | Pauchet |
| 2004/0129296 | A1 | 7/2004 | Treacy et al. |
| 2006/0123955 | A1 | 6/2006 | Cho |
| 2006/0243295 | A1 | 11/2006 | Petit |
| 2007/0006412 | A1 | 1/2007 | Soller et al. |
| 2008/0087296 | A1 | 4/2008 | Gueret |
| 2009/0241981 | A1 | 10/2009 | Dobler et al. |
| 2009/0324318 | A1 | 12/2009 | Wilde et al. |
| 2012/0067367 | A1 | 3/2012 | Stewart et al. |
| 2012/0266910 | A1 | 10/2012 | Tarling et al. |
| 2013/0061867 | A1 | 3/2013 | Kim et al. |
| 2013/0133678 | A1 | 5/2013 | Nakashima |
| 2015/0282593 | A1* | 10/2015 | Earl ..... A45D 40/26 401/88 |
| 2016/0120289 | A1 | 5/2016 | Viscomi |
| 2016/0174679 | A1 | 6/2016 | Gorostiza et al. |
| 2016/0199162 | A1 | 7/2016 | Brilliant et al. |
| 2017/0224088 | A1 | 8/2017 | Parekh |
| 2019/0029398 | A1 | 1/2019 | Zhang |
| 2019/0053606 | A1 | 2/2019 | Thorpe et al. |
| 2019/0281952 | A1 | 9/2019 | Meranus |
| 2020/0128939 | A1 | 4/2020 | Kim et al. |
| 2022/0031045 | A1 | 2/2022 | Trochel |
| 2022/0386758 | A1 | 12/2022 | Kobashi |

FOREIGN PATENT DOCUMENTS

| | | | |
|---|---|---|---|
| WO | WO-2009/054918 | A1 | 4/2009 |
| WO | WO-2012141522 | A2 | 10/2012 |

OTHER PUBLICATIONS

Taiwan Patent Application No. 111121730, Office Action, dated Mar. 14, 2023.
Taiwan Patent Application No. 111121731, Office Action, dated Mar. 15, 2023.
Taiwan Patent Application No. 111121728, Office Action, dated Mar. 13, 2023.
International Application No. PCT/US2022/032919, International Search Report and Written Opinion, dated Oct. 7, 2022.
International Application No. PCT/US2022/032920, International Search Report and Written Opinion, dated Oct. 4, 2022.
International Application No. PCT/US2022/032921, International Search Report and Written Opinion, dated Oct. 7, 2022.

* cited by examiner

COSMETIC PRODUCT SAMPLING SYSTEM

FIELD OF THE DISCLOSURE

The present disclosure generally relates to cosmetic, hair care, body care, and/or skincare products and, more particularly, to systems and approaches for sample, trial, and/or full-sized products.

BACKGROUND

Cosmetic and/or skincare products and applicators may have a number of different visual characteristics. For example, products such as lipstick may be provided in varying colors or shades, sheen levels (e.g., matte, satin, or sheer), and/or may have varying degrees of transfer resistance. Oftentimes, consumers may wish to test a number of different products prior to purchasing full-sized versions of the product. Existing sampling systems oftentimes includes excessive amounts of disposable packaging that may be costly to manufacture and/or may present environmental concerns. Current sampling and trial experiences may not mimic a full-sized product, and as such, may not provide a consumer with a similar experience as when using the full-sized product. More specifically, current sampling and trial experiences are provided in small sizes that may be difficult to hold and may present other ergonomic challenges. In the event a consumer has a variety of different samples each having discrete packaging, the user would need to carry the individual packages on their person, which may be confusing and present a barrier to trial.

Accordingly, there is a need for improved accessories having improved functionalities.

SUMMARY

Embodiments within the scope of the present disclosure are directed to a system for sample, trial, and/or full-sized products. Such a system may include a container defining at least one cavity, a product disk, a cosmetic product, and an applicator. The product disk includes a first side, a second side, a body extending therebetween, and a disk release mechanism. At least a portion of the first side of the product disk is selectively positionable adjacent to the at least one cavity of the container. The cosmetic product is at least partially disposed on the first side of the product disk. The applicator has first end that includes an applicator retention region and an applicator release region. The product disk is insertably coupled with the applicator retention region.

In some examples, the applicator retention region may include a sidewall defining a cavity that is dimensioned to engage the body of the product disk. In some approaches, the disk release mechanism includes at least one protrusion extending outwardly from the body. Further, the applicator release region may include a channel that receives the at least one protrusion. In some of these approaches, the product disk may be released from the applicator retention region by urging the at least one protrusion of the disk release mechanism in a direction away from the first end of the applicator.

In some forms, the first side of the product disk is adapted to be disposed within the at least one cavity of the container. In these and other examples, the container may further define an applicator cavity adapted to retain at least a portion of the applicator. Further, the at least one cavity may include a retention member that retains the product disk. The retention member may be in the form of at least one of a magnetic member, a sidewall, or a protrusion.

In some examples, the cosmetic and/or skincare product may be in the form of at least one of a lipstick, a foundation, a concealer, an eyeshadow, a bronzer, a brow, a solid serum, a solid SPF product, a skin care item, a solid face balm, a lip balm, an applicator heads, a brush, a solid blush, a solid contouring stick, an impregnated sponge or carrier, or a semi-solid skin care or cosmetic product.

In some approaches, the body of the product disk may define a visual indicator that allows identification of the cosmetic product when the product disk is positioned adjacent to the at least one cavity.

In some examples, the container may define a second cavity. The system may further include a second cosmetic product being at least partially disposed on a second product disk. The second cosmetic product may have a different visual characteristic than a visual characteristic of the cosmetic product.

In accordance with a second aspect, a reusable product system includes an applicator, a product disk, and a cosmetic product. The applicator includes a first end having an applicator retention region and an applicator release region. The product disk has a first side, a second side, a body extending therebetween, and a disk release mechanism. The cosmetic product is at least partially disposed on the first side of the product disk. The product disk insertably couples with the applicator retention region.

BRIEF DESCRIPTION OF THE DRAWINGS

The above needs are at least partially met through provision of one, more than one, or any combination of the approaches for cosmetic and/or skincare sampling systems described in the following detailed description, particularly when studied in conjunction with the drawings, wherein.

Figure 1:
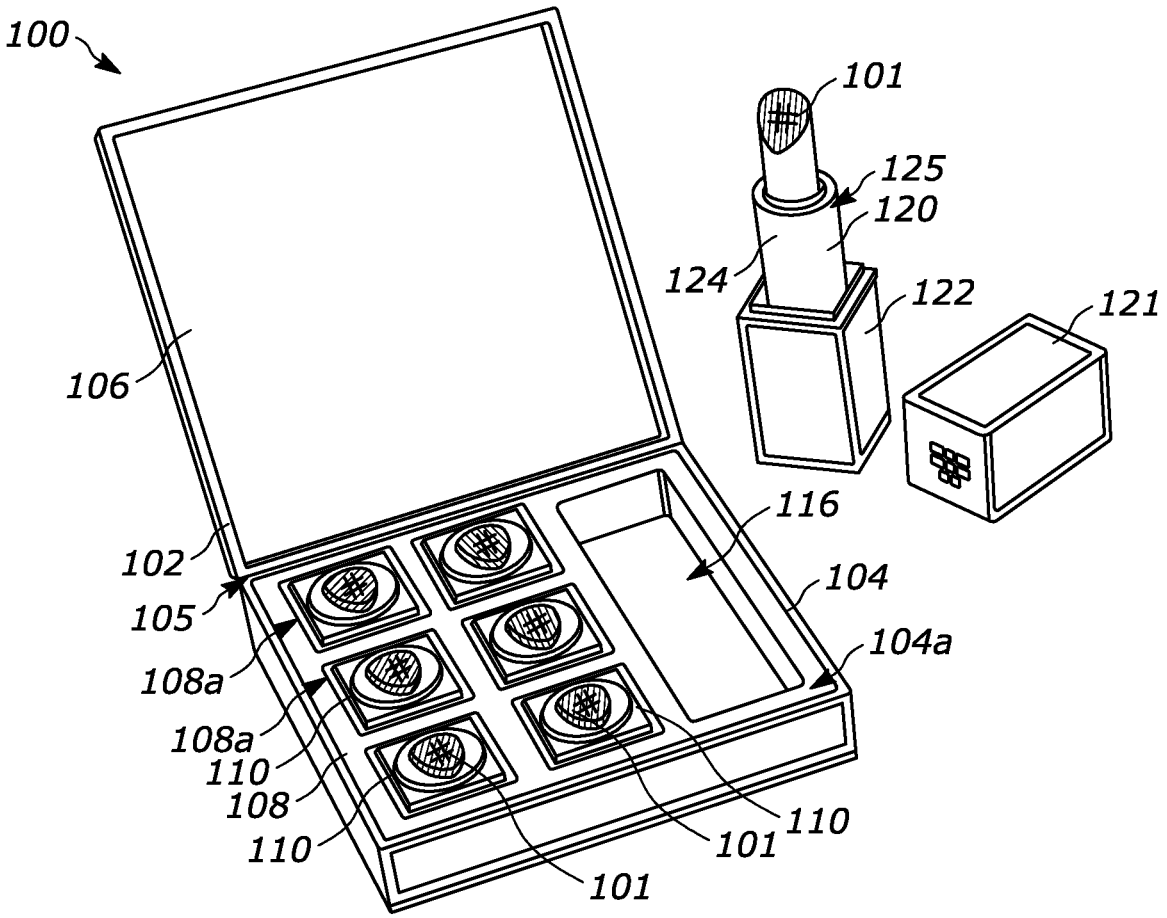
FIG. 1 illustrates a perspective view of an example sampling and/or trial system in accordance with various embodiments.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various examples. Also, common but well-understood elements that are useful or necessary in a commercially feasible examples are often not depicted in order to facilitate a less obstructed view of these various examples. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, pursuant to these various approaches, a sampling and/or trial system for a product is provided having modular features. The sampling systems described herein allow for users to quickly and seamlessly replace or interchange different cosmetic and/or skincare products and applicators as desired to apply to their face and/or skin. The system may use reusable components and may reduce overall product packaging requirements. In some examples, upon a user determining which of the sample products they wish to purchase in larger (i.e., full-sized) quantities, the system may similarly accommodate such larger quantities therein.

Turning to the figures, a cosmetic and/or skincare sampling system 100 includes a cosmetic and/or skincare product 101, a container 102, an applicator 120, and any number of product disks 140. While the illustrated examples depict a lipstick product, in other examples, the product 101 may be any number or combination of different cosmetic and/or skincare products. For example, the product 101 may be in the form of a foundation, a concealer, an eyeshadow, a bronzer, a brow, a solid serum, a solid SPF product, a skincare item, a solid face balm, a lip balm, an applicator head such as a sponge, a brush, a solid blush, a solid contouring stick, an impregnated sponge or carrier capable of retaining a liquid skincare or cosmetic product, or a semi-solid skincare or cosmetic product.

The container 102 includes a base 104 having an interior cavity 104*a*, a lid 106, and a hinge 105 that rotatably couples the lid 106 with the base 104. In other examples (not illustrated) the lid 106 may be operably coupled with the base 104 via any number of suitable approaches such as, for example, a friction fit connection, a threaded connection, a magnetic connection, a vacuum or suction mechanism, and the like. Other examples are possible. The container 102 may be constructed from any number of suitable materials and/or combinations of materials such as, for example, metals, polymers, and the like. As illustrated in FIG. 1, the container 102 has a generally rectangular prismatic shape, though other suitable examples such as cylindrical are possible.

Figure 2:
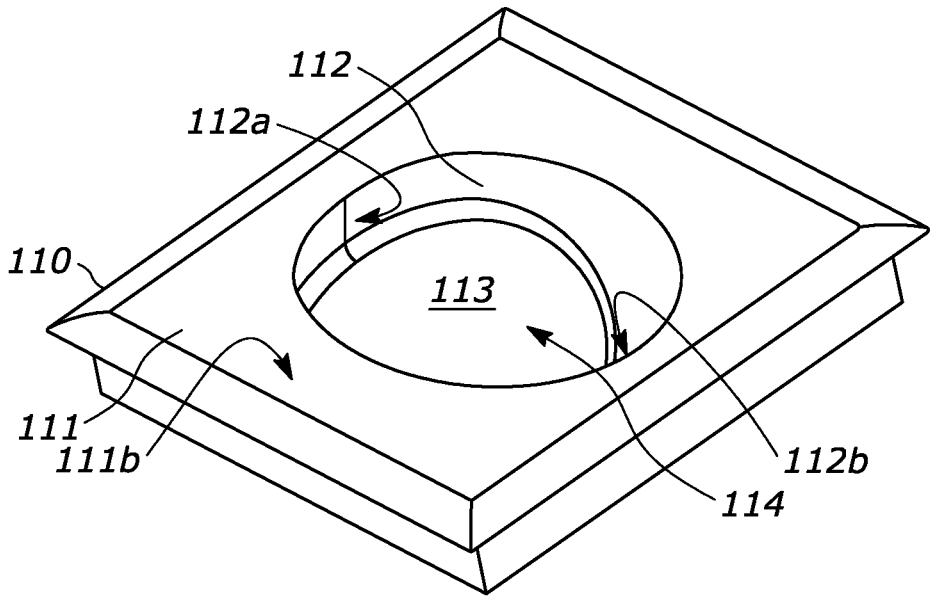
FIG. 2 illustrates a perspective view of an example tray adapted to retain a product for use with the example sampling system of FIG. 1 in accordance with various embodiments.
Figure 3:
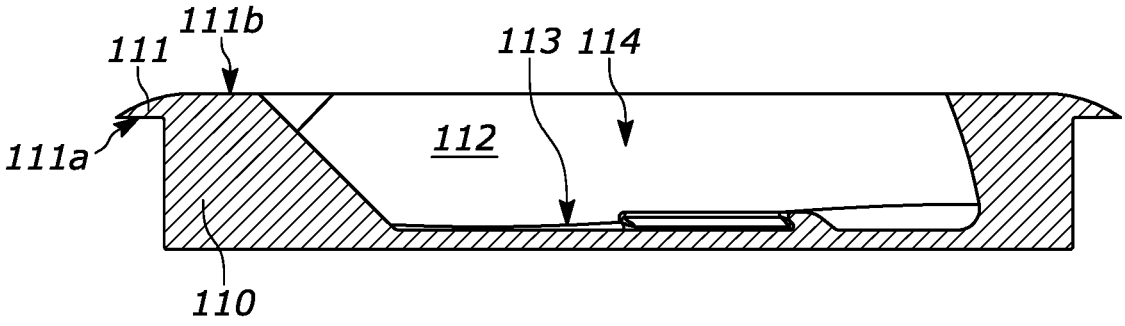
FIG. 3 illustrates a right side elevation cross-sectional view of the example tray of FIG. 2 in accordance with various embodiments.

The container 102 further includes a divider or top plate 108 having a number of openings 108*a* (e.g., six) dimensioned to receive a corresponding number of trays 110. The divider 108 may also include an applicator opening 108*b* dimensioned to receive the applicator 120. With reference to FIGS. 2 & 3, each tray 110 includes a support ledge 111 having a lower surface 111*a* and an upper surface 111*b*, a sidewall 112 extending downwardly from the support ledge 111, and a lower surface 113. The lower surface 111*a* of the support ledge 111 is adapted to rest on (i.e., is positionable adjacent to) the divider 108 such that the remainder sidewall 112 and the lower surface 113 are at least partially disposed within is in the opening 108*a* (and thus into the interior cavity 104*a* of the base 104). In some examples, the lower surface 111*a* of the support ledge 111 (and thus the tray 110) and the divider 108 may be coupled with each other using magnets, adhesives, a friction-fit coupling, and the like. Other examples are possible.

Figure 4:
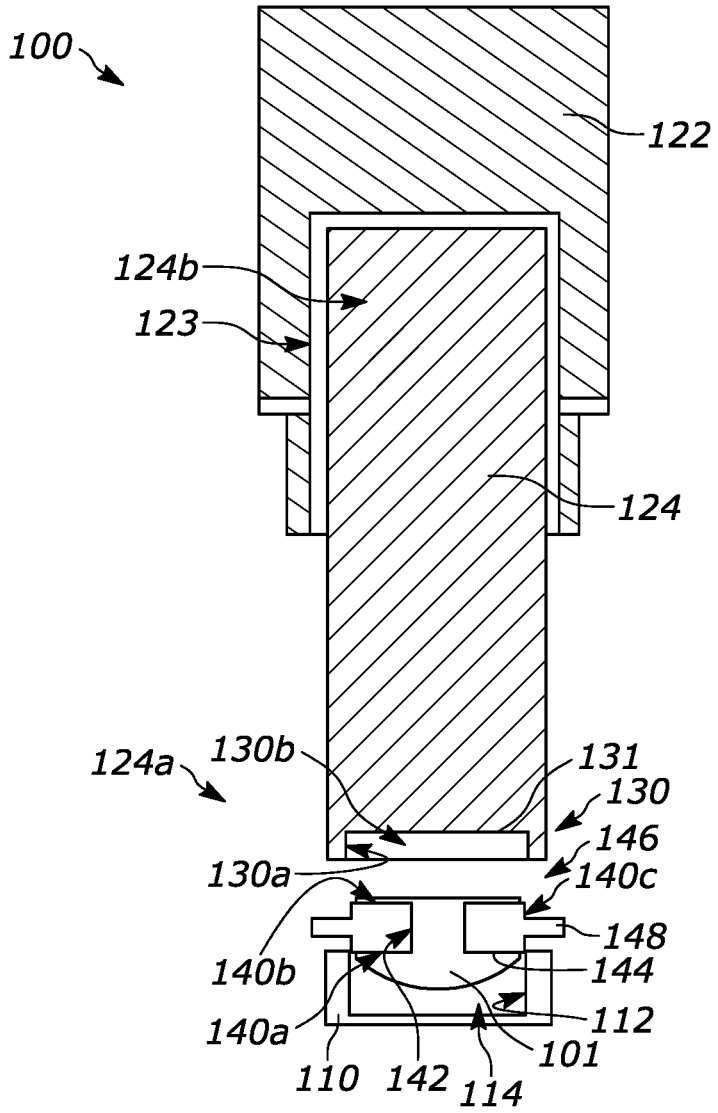
FIG. 4 illustrates a cross-sectional schematic view of an example applicator positioned near an example product disk that is positioned adjacent to the example tray of FIGS. 2 and 3 in accordance with various embodiments.
Figure 5:
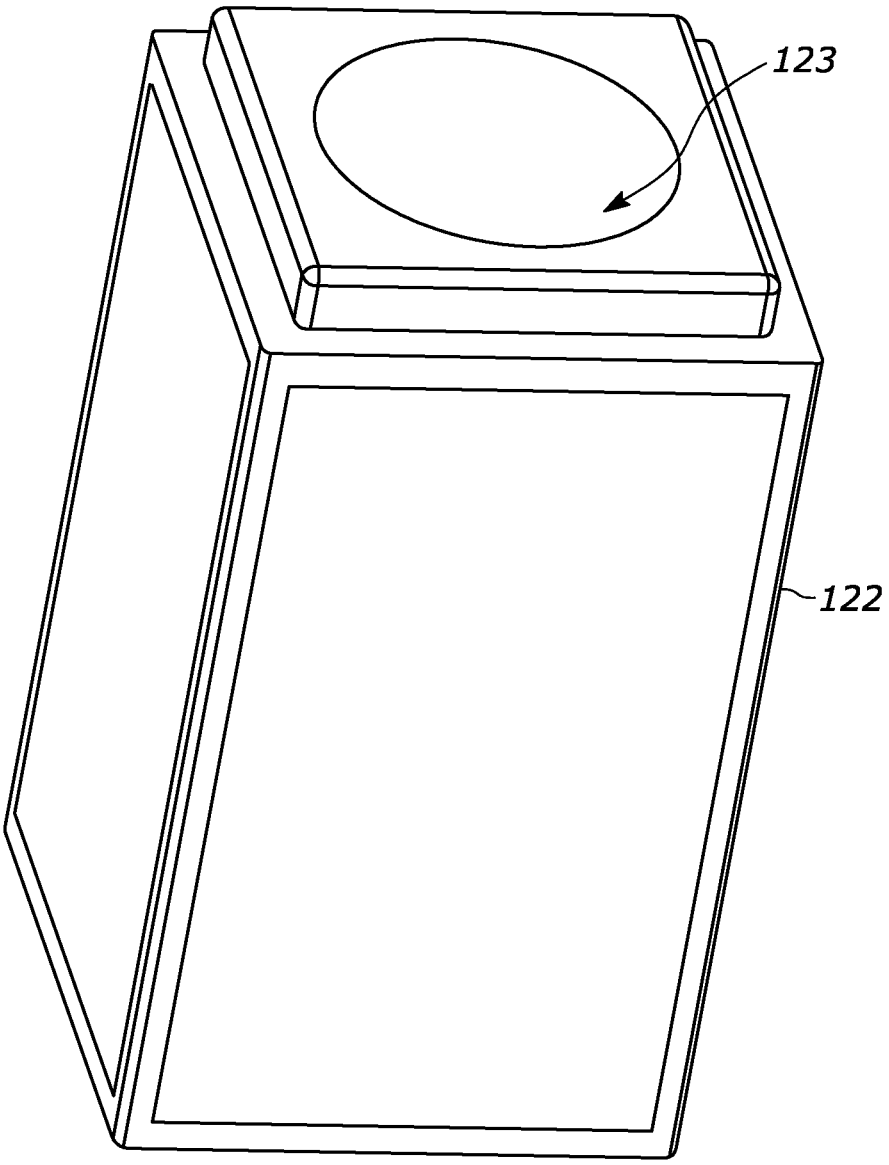
FIG. 5 illustrates a perspective view of an example applicator base for use with the example sampling system of FIGS. 1-4 in accordance with various embodiments.

As illustrated in FIGS. 3 & 4, the sidewall 112 and the lower surface 113 combine to define a cavity 114 which is dimensioned to receive and/or retain at least a portion of the product disk 140 and/or a quantity of cosmetic product 101 disposed thereon. As illustrated in FIG. 3, in some examples, the sidewall 112 may have a curved, angled and/or tapered surface relative to the lower surface 113. In these configurations, the sidewall 112 may act as a stop mechanism to retain and/or prevent the product disk 140 from advancing further in a downward direction into the cavity 114 by frictional engagement therebetween. In other examples, such a stop mechanism may be in the form of a frictional engagement, a notch, a tab, a protrusion, and the like. Other examples are possible. In yet other examples, the sidewall 112 may include a ledge region (not illustrated) to retain and/or prevent the product disk 140 from advancing further into the cavity 114.

With reference to FIGS. 1 and 4-7, the applicator 120 includes a cap 121, an applicator base 122, and an applicator tube 124 having an applicator retention region 130 and an applicator release region 132. The applicator base 122 may be used as a handle a user grasps when applying the desired cosmetic product 101, and includes an opening 123 to receive a portion of the applicator tube 124. The applicator tube 124 includes a first end 124*a*, a second end 124*b*, the applicator retention region 130, and the applicator release region 132. The applicator tube 124 extends along a longitudinal axis "A". In the illustrated example, the applicator tube 124 is generally cylindrical in shape, though other configurations are possible.

The second end 124*b* of the applicator tube 124 is insertable into the opening 123 of the applicator base 122, and may be secured therewith via a number of approaches such as, for example, a threaded connection, a friction-fit connection, the use of protrusions and corresponding notches, and the like. In some examples, the applicator base 122 and the applicator tube 124 may be movably coupled with each other such that relative axial movement therebetween may be permitted. Other examples are possible.

The applicator retention region 130 is positioned at the first end 124*a* of the applicator tube 124 and is in the form of a countersunk region defining a sidewall 130*a* and a ledge 131 having a diameter that is less than the diameter of the first end 124*a* of the applicator tube 124. The sidewall 130*a* and the ledge 131 define a cavity and are dimensioned to receive and engage a portion of the product disk 140. In the illustrated example, the applicator retention region 130 is integrally formed with the applicator tube 124. But in other examples (not illustrated), the applicator retention region 130 may be operably coupled with the first end 124*a* of the applicator tube using any number of suitable approaches such as, for example, a friction-fit engagement. However, other arrangements are possible. The applicator retention region 130 is generally hollow and defines an interior cavity 130*b*.

In the illustrated examples, the first end 124*a* of the applicator tube 124 (and thus the applicator retention region 130) is obliquely angled relative to the longitudinal axis A, though other relative configurations are possible. Accordingly, in this configuration, the first end 124*a* of the applicator tube 124 has a generally planar, ovoid shape.

Figure 6:
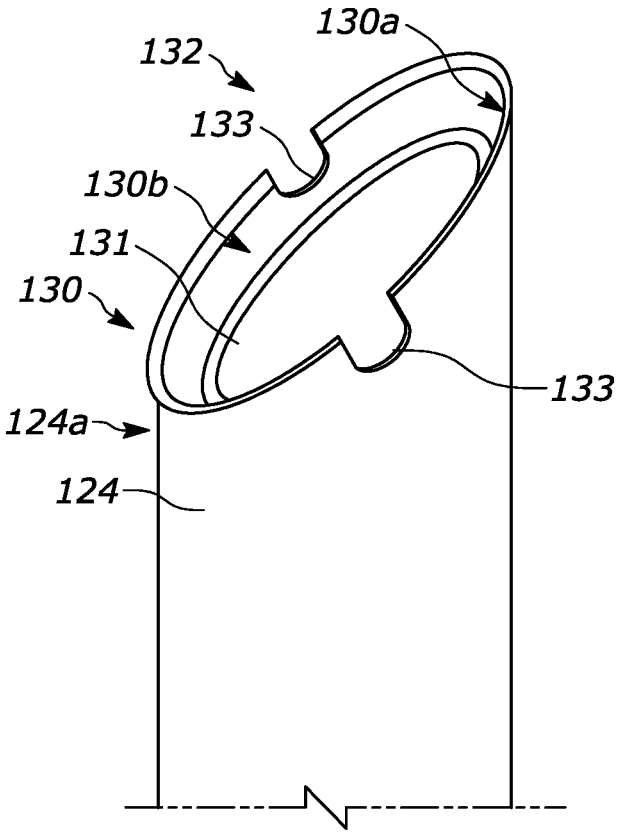
FIG. 6 illustrates a perspective view of an example product disk coupled with an example applicator tube for use with the system of FIGS. 1-5 in accordance with various embodiments.
Figure 7:
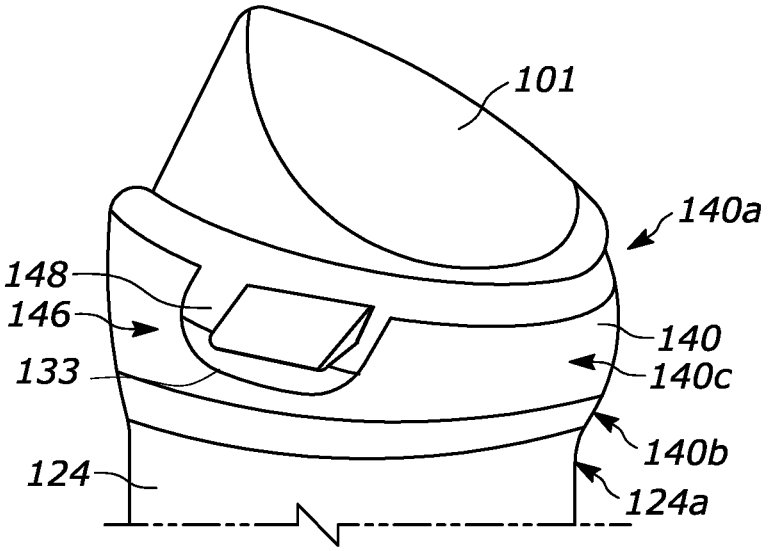
FIG. 7 illustrates a perspective view of an example product disk disposed in an example applicator for use with the system of FIGS. 1-6 in accordance with various embodiments.
Figure 8:
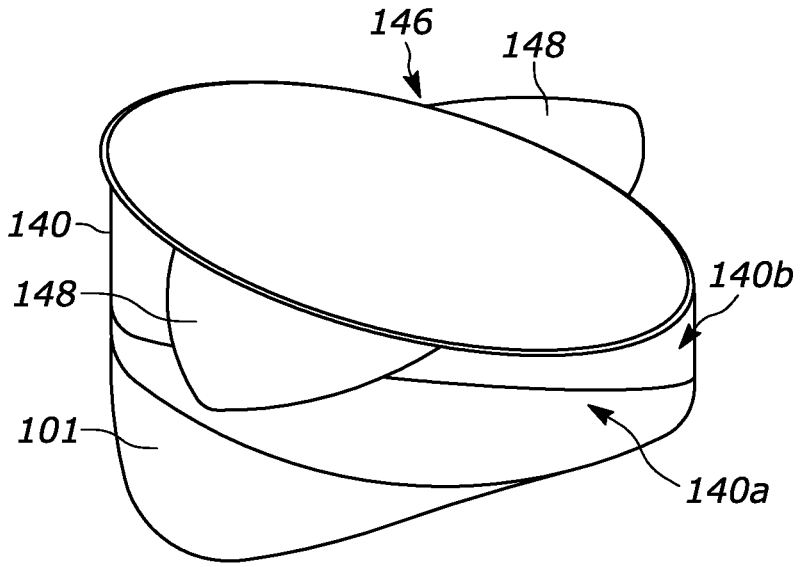
FIG. 8 illustrates a perspective view of an example product disk for use with the system of FIGS. 1-7 in accordance with various embodiments.
Figure 9:
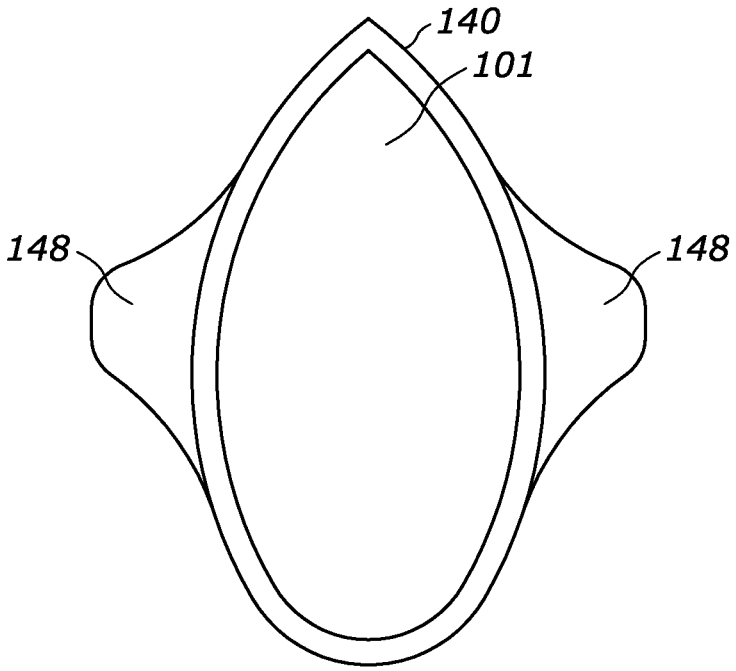
FIG. 9 illustrates a top plan view of the example product disk of FIGS. 1-8 in accordance with various embodiments.
Figure 10:
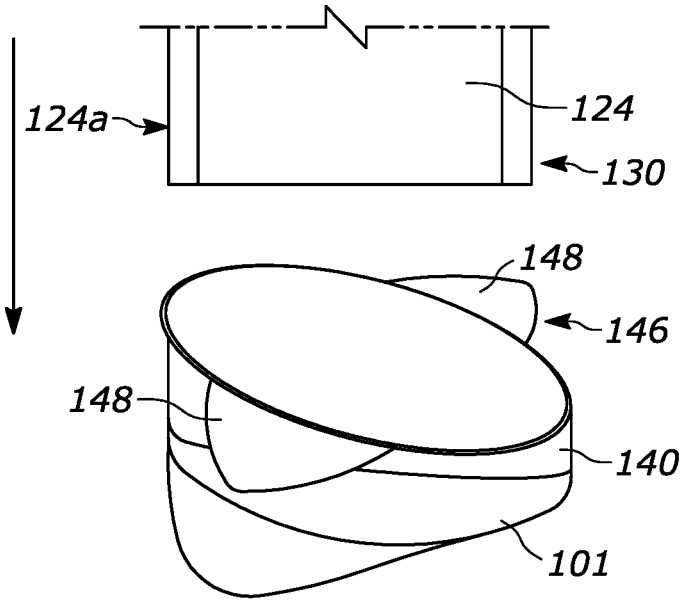
FIG. 10 illustrates a perspective view of an example product disk being coupled with an example applicator tube for use in the system of FIGS. 1-9 in accordance with various embodiments.

As illustrated in FIGS. 6 & 7, the applicator release region 132 is also positioned at the first end 124*a* of the applicator tube 124. In these examples, the applicator release region 132 is in the form of at least one cutout, channel, or opening 133 formed along the sidewall 130*a* and extending downwardly towards the ledge 131.

Turning to FIGS. 4 & 7-11, the product disk 140 is in the form of a body having a first or lower side 140*a*, a second or upper side 140*b*, and an outer sidewall 140*c*. In some examples, each of the first and second sides 140*a*, 140*b* are generally planar. However, other arrangements are possible. The first side 140*a* of the product disk 140 includes a product receiving surface 144. The product receiving surface 144 is dimensioned to receive a sample quantity of product 101 thereon. For example, the product receiving surface 144 may accommodate a quantity of lipstick sufficient for between approximately two and approximately ten applications. Other examples of suitable quantities are possible. In the illustrated example, the product 101 protrudes outwardly from the product receiving surface 144 and forms an oval shape, though other arrangements are possible depending on the desired application style and/or profile.

The product disk 140 also includes at least one throughbore 142 extending between the first side 140*a* and the second side 140*b*. As illustrated in FIG. 4, the throughbore or throughbores 142 allow either a portion of the product 101 to be disposed therethrough and/or alternatively may operate as a window or visual indicator that allows a user to determine the appearance (e.g., the shade, color, and/or other visual characteristic) of the product 101 disposed on the product receiving surface 144 of the product disk 140 when positioned within the cavity 114 of the tray 110. In some examples, the at least one throughbore 142 allows a layer of product 101 to be disposed on the second side 140*b* of the product disk 140.

The product disk 140 further includes a disk release mechanism 146 in the form of at least one protrusion 148. In the illustrated examples, the at least one protrusion is located on the outer sidewall 140*c* of the product disk 140. However, in other examples (not illustrated) the at least one protrusion may be located on or near the first side 140*a* and/or the second side 140*b* of the product disk as desired. More specifically, the protrusion 148 is in the form of a wing or lever extending radially outwardly from the body 140*c* of the product disk 140. Generally speaking, a user may engage the protrusion 148 to decouple the product disk 140 from the applicator tube 124.

At least a portion of the outer sidewall 140*c* of the product disk 140 (i.e., the portion near the second side 140*b*) is dimensioned and configured to be received and/or nest within the ledge or countersunk region 131 of the applicator retention region 130. In this arrangement, the second side 140*b* of the product disk 140 may be at least partially disposed within the interior cavity 130*b* of the applicator retention region 130. Similarly, the product disk 140 is dimensioned such that it may be positioned adjacent to and/or at least partially within the cavity 114 of the tray 110. More specifically, in some arrangements, the outer sidewall 140*c* of the product disk 140 may have a dimension that is smaller than the corresponding dimension of the periphery of the cavity 114 of the tray as defined by the sidewall 112. Accordingly, at least a portion of the body of the product disk 140 (i.e., the first side 140*a*) may be positionable and/or nestable within the cavity 114 of the tray 110.

In some examples and as previously noted, the tapered configuration of the sidewall 112 may serve as a physical restriction that prevents the product disk 140 from being disposed further into the cavity 114 of the tray 110. As a result, when the product disk 140 is positioned adjacent to and/or at least partially within the cavity 114, a space or gap may be formed between the product receiving surface 144 of the product disk 140 and the lower surface 113 of the tray 110 that is sufficiently sized to retain the product 101. Accordingly, the product 101 may be safely disposed within the cavity 114 without being damaged by the sidewall 112 and/or the lower surface 113 of the tray 110. So arranged, the second side 140*b* of the product disk 140 in addition to a portion of the outer sidewall 140*c* may extend upwardly from the upper surface 111*b* of the support ledge 111.

In operation, any number of product disks 140 may be removably retained within individual cavities 114 of trays 110, which in turn are disposed within respective openings 108*a* of the divider 108, which is disposed within the interior cavity 104*a* of the base 104. Each of these disks 140 may include samples of the product 101 having different visual characteristics (e.g., varying colors or shades, sheen levels (e.g., matte, satin, or sheer), and/or may have varying degrees of transfer resistance). A user may determine which product 101 sample they wish to apply by viewing the product 101 through the throughbore 142 of the product disk 140 (or alternatively by simply viewing the portion of product 101 that is disposed on the second side 140*b* of the product disk 140).

Upon selecting the desired product 101, the user may position the first end 124*a* of the applicator tube 124, and more specifically, the applicator retention region 130, near the second side 140*b* of the product disk 140, and may move the applicator 120 towards the product disk 140 in axial direction (along axis A) such that the second side 140*b* of the product disk enters the interior cavity 130*b* of the applicator retention region 130. In this position, the outer sidewall 140*c* of the product disk 140 is nested within the ledge 131 of the applicator retention region 130 to retain the product disk 140 within a portion of the interior cavity 130*b* thereof. Such an engagement between the product disk 140 and the applicator retention region 130 may be a friction-fit connection. In this configuration, the at least one protrusion 148 of the disk release mechanism 146 is at least partially disposed within the cutout 133 of the applicator release region 132. A user may then lift the applicator 120 away from the tray 110, which will in turn cause the product disk 140 to be removed therefrom. The user may then apply the sample of the product 101, which is disposed on the outwardly-facing first side 140*a* of the product disk 140, as desired.

So configured, the sidewall 130*a* and the ledge 131 cooperate to retain the product disk 140 in a secure manner. In some examples, the engagement between the applicator 120 and the product disk 140 may generate a tactile feedback to alert the user that the applicator 120 and the product disk 140 are fully coupled together. Further, in some examples, at least a portion of the product disk 140 and/or the applicator retention region 130 may be formed from a magnetic material that causes the product disk 140 to be magnetically secured with the applicator 120.

In some examples, the user may place the cap 121 onto the applicator base 122 while the product disk 140 is coupled with the applicator 120 for the purposes of storage.

The product disk 140 may be decoupled from the applicator 120 by manually sliding or pushing the protrusions 148 out of the cutout 133 of the applicator release region 132. A user positions the first side 140*a* near and/or within the cavity 114 of the tray 110 and urges the protrusion 148 in an axial direction out of the first end 124*a* of the applicator tube 124. Such urging causes the product disk 140 to slide out of the ledge 131, thus decoupling the product disk 140 from the applicator retention region 130 and allowing the product disk to drop into or near the desired cavity 114. In some examples, the sidewall 112 may include a magnet that assists with retaining the product disk 140 within the cavity 114.

Upon selectively decoupling the product disk 140 from the applicator 120, a user may couple a different product disk 140 therewith to apply the desired product 101 or may return the applicator to the applicator cavity 116 as desired. So configured, a user may quickly selectively sample any number of varying cosmetic and/or skincare products 101 to determine a desired product for subsequent purchase. In some examples, the applicator tube 124 may be dimensioned to accommodate a full-sized quantity of product 101 to allow for the use of the same applicator 120 used to sample varying products 101. In such examples, the applicator tube 124 may include an advance/retract mechanism. In other examples, the applicator tube 124 may be removed from the base 122 when the user determines which full-sized product they wish to purchase, and a replacement applicator (not illustrated) may be inserted into the base 122 that includes a full-sized quantity of product 101. In some examples, the product disks 140 may be reused and/or recycled upon returning them to the manufacturer, thereby potentially reducing overall component and manufacturing costs.

Figure 11:
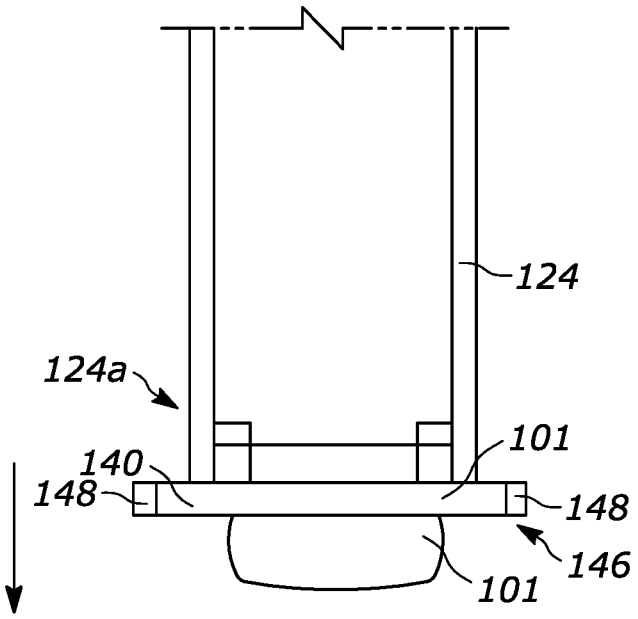
FIG. 11 illustrates the example product disk and applicator tube of FIG. 10 in a coupled configuration in accordance with various embodiments.

It will be appreciated that any number of modifications may be made to the system 100. For example, as illustrated in FIG. 11, in some approaches, the protrusions 148 may not be disposed within a cutout 133 when the product disk 140 is coupled with the applicator tube 124. Rather, the protrusions 148 may abut the first end 124*a* of the applicator tube 124 (i.e., an end of the sidewall 130*a* of the applicator retention region 130). In such an arrangement, the protrusions 148 extend in a radial distance beyond an exterior diameter of the applicator tube 124, and as such, a user may urge the product disk 140 from the applicator tube 124 in a similar manner as described above.

Figure 12:
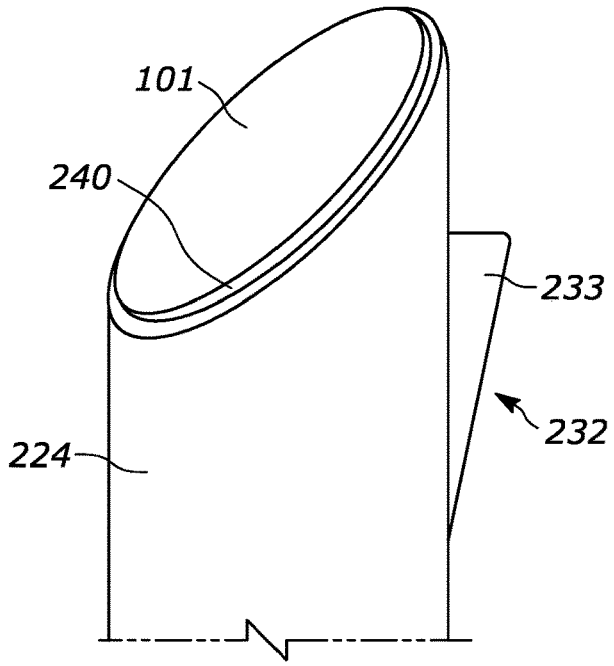
FIG. 12 illustrates a perspective view of an alternative example applicator tube and product disk in a coupled configuration in accordance with various embodiments.
Figure 13:
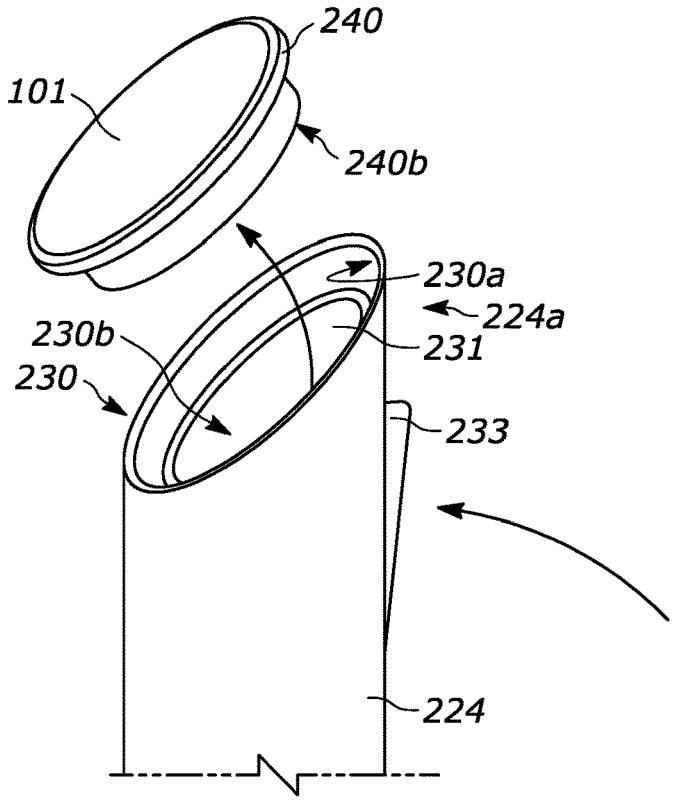
FIG. 13 illustrates a perspective view of the alternative example applicator tube and product disk of FIG. 12 in a decoupled configuration in accordance with various embodiments.

FIGS. 12 & 13 illustrate an alternative applicator tube 224 having an applicator release region 232 in the form of a push-to-release mechanism 233. The push-to-release mechanism 233 is disposed on the applicator tube 224, and may be depressed by a user to cause an urging member disposed at the first end 224*a* of the applicator tube 224 to engage the second side 240*b* of the product disk 240 to urge the product disk 240 from the applicator retention region 230.

In some examples (not illustrated), the applicator retention region 130, the applicator release region 132, and the disk coupling mechanism 146 may have opposite configurations whereby the applicator is inserted into a portion of the product disk. Other arrangements are possible.

Further, in some alternative arrangements, a sampling system may be provided with a single applicator base adapted to receive a number of applicator tubes, each of which being configured to accommodate a product (e.g., a sample quantity of a lipstick or other cosmetic and/or skincare product) having a unique visual or other characteristic. More specifically, in these examples, a container may be provided that is dimensioned to receive and retain a number of applicator tubes. In some examples, each of the distinct applicator tubes may include a visual indicator of the color of the product disposed thereon. Upon a user selecting the desired product, they may couple the base with the applicator tube and apply the product. This coupling between the base and the applicator tube may be a friction-fit engagement, a threaded coupling, and the like. The user may then choose to return the applicator tube to its designated storage location in the container by decoupling the applicator tube from the base, or may alternatively place the complete applicator (i.e., the base, the applicator tube, and/or the cap) into the applicator cavity of the container.

In the foregoing specification, specific examples have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings. Additionally, the described examples/implementations should not be interpreted as mutually exclusive, and should instead be understood as potentially combinable if such combinations are permissive in any way. In other words, any feature disclosed in any of the aforementioned examples/implementations may be included in any of the other aforementioned examples/implementations.

The benefits, advantages, solutions to problems, and any element(s) that may cause any benefit, advantage, or solution to occur or become more pronounced are not to be construed as a critical, required, or essential features or elements of any or all the claims. The claimed invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

The patent claims at the end of this patent application are not intended to be construed under 35 U.S.C. § 112(f) unless traditional means-plus-function language is expressly recited, such as "means for" or "step for" language being explicitly recited in the claim(s).

What is claimed is:

1. A system for sample, trial, and/or full-sized products comprising:

a container defining at least one cavity;

a product disk having a first side, a second side, a body extending therebetween, and a disk release mechanism, the product disk being positionable adjacent to the at least one cavity;

a cosmetic and/or skincare product being at least partially disposed on the first side of the product disk;

an applicator having a first end, the first end including an applicator retention region and an applicator release region; and at least one throughbore extending between the first side and the second side of the product disk, the at least one throughbore adapted to provide a visual indication of the cosmetic product when the product disk is positioned adjacent to the at least one cavity;

wherein the product disk is adapted to insertably couple with the applicator retention region.

2. The system of claim 1, wherein the applicator retention region includes a sidewall defining a cavity dimensioned to engage the body of the product disk.

3. The system of claim 1, wherein the disk release mechanism includes at least one protrusion extending outwardly from the body, the applicator release region including a channel adapted to receive the at least one protrusion.

4. The system of claim 3, wherein the product disk is released from the applicator retention region by urging the at least one protrusion of the disk release mechanism in a direction away from the first end of the applicator.

5. The system of claim 1, wherein the first side of the product disk is adapted to be disposed within the at least one cavity of the container.

6. The system of claim 1, wherein the container further defines an applicator cavity adapted to retain at least a portion of the applicator.

7. The system of claim 1, wherein the at least one cavity of the container includes a retention member adapted to retain the product disk.

8. The system of claim 7, wherein the retention member includes at least one of a magnetic member, a sidewall, or a protrusion.

9. The system of claim 1, wherein the cosmetic and/or skincare product includes at least one of a lipstick, a foundation, a concealer, an eyeshadow, a bronzer, a brow, a solid serum, a solid spf product, a skin care item, a solid face balm, a lip balm, an applicator head, a brush, a solid blush, a solid contouring stick, an impregnated sponge or carrier, or a semi-solid skin care or cosmetic product.

10. The system of claim 1, the container defining a second cavity, the system further including a second cosmetic product being at least partially disposed on a second product disk, the second cosmetic product having a different visual characteristic than a visual characteristic of the cosmetic product.

11. A reusable product system comprising:

an applicator having a first end, the first end including an applicator retention region and an applicator release region;

a product disk having a first side, a second side, a body extending therebetween, and a disk release mechanism;

a cosmetic product being at least partially disposed on the first side of the product disk; and at least one throughbore extending between the first side and the second side of the product disk, the at least one throughbore adapted to provide a visual indication of the cosmetic product;

wherein the product disk is adapted to insertably couple with the applicator retention region.

12. The reusable cosmetic system of claim 11, wherein the applicator retention region includes a sidewall defining a cavity dimensioned to engage the body of the product disk.

13. The reusable cosmetic system of claim 11, wherein the disk release mechanism includes at least one protrusion extending outwardly from the body, the applicator release region including a channel adapted to receive the at least one protrusion.

14. The reusable cosmetic system of claim 13, wherein the product disk is released from the applicator retention region by urging the at least one protrusion of the disk release mechanism in a direction away from the first end of the applicator.

15. The reusable cosmetic system of claim 11, wherein the applicator further includes an interior cavity adapted to receive at least a portion of the cosmetic product on the second side of the product disk.

16. The reusable product system of claim 11, wherein the cosmetic and/or skincare product includes at least one of a lipstick, a foundation, a concealer, an eyeshadow, a bronzer, a brow, a solid serum, a solid spf product, a skin care item, a solid face balm, a lip balm, an applicator head, a brush, a solid blush, a solid contouring stick, an impregnated sponge or carrier, or a semi-solid skin care or cosmetic product.

17. A system for sample, trial, and/or full-sized products comprising:

a container defining at least one cavity;

a product disk having a first side, a second side, a body extending therebetween, and a disk release mechanism, the product disk being positionable adjacent to the at least one cavity;

a cosmetic and/or skincare product being at least partially disposed on the first and second sides of the product disk; and an applicator having a first end, the first end including an applicator retention region and an applicator release region;

wherein the product disk is adapted to insertably couple with the applicator retention region.

* * * * *